US010399077B2

(12) United States Patent
Rego et al.

(10) Patent No.: US 10,399,077 B2
(45) Date of Patent: Sep. 3, 2019

(54) DUAL FLASK

(71) Applicants: Daniel Rego, Las Vegas, NV (US); Kenneth R. Czerwinski, Seattle, WA (US)

(72) Inventors: Daniel Rego, Las Vegas, NV (US); Kenneth R. Czerwinski, Seattle, WA (US)

( * ) Notice: Subject to any disclaimer, the term of this patent is extended or adjusted under 35 U.S.C. 154(b) by 544 days.

(21) Appl. No.: 14/659,241

(22) Filed: Mar. 16, 2015

(65) Prior Publication Data

US 2015/0258541 A1 Sep. 17, 2015

Related U.S. Application Data

(60) Provisional application No. 61/954,136, filed on Mar. 17, 2014.

(51) Int. Cl.
*B01L 3/00* (2006.01)
*B01L 3/08* (2006.01)

(52) U.S. Cl.
CPC ..... *B01L 3/08* (2013.01); *B01L 3/569* (2013.01); *B01L 2300/0681* (2013.01); *B01L 2300/0861* (2013.01); *B01L 2400/0644* (2013.01)

(58) Field of Classification Search
CPC ..... B01L 3/08
See application file for complete search history.

(56) References Cited

U.S. PATENT DOCUMENTS 3,456,672 A * 7/1969 Randall ..... B01L 3/569 137/193
3,956,125 A * 5/1976 Strutt ..... B01L 3/00 210/232
4,693,834 A * 9/1987 Hossom ..... B01L 3/502 210/451
5,603,900 A * 2/1997 Clark ..... B01D 29/012 210/321.75
2002/0173046 A1* 11/2002 Hafez ..... B01L 3/502 436/176
2003/0200788 A1* 10/2003 Newbound ..... G01N 7/10 73/31.03

* cited by examiner

*Primary Examiner* — Matthew D Krcha
(74) *Attorney, Agent, or Firm* — Fish & Richardson P.C.

(57) ABSTRACT

This document provides a dual flask for laboratory use, methods of using a dual flask, and systems including a dual flask. A dual flask can include a first flask structure and a second flask structure. Each flask structure can include a body and a neck. The first body and the second body in a dual flask provided herein can be connected together and have a filter there between such that fluids can be filtered between said first and second bodies.

20 Claims, 4 Drawing Sheets

DUAL FLASK

CROSS-REFERENCE TO RELATED APPLICATIONS

This application claims the benefit of U.S. Provisional Application Ser. No. 61/954,136, filed Mar. 17, 2014. The disclosure of the prior applications is considered part of (and is incorporated by reference in) the disclosure of this application.

STATEMENT AS TO FEDERALLY SPONSORED RESEARCH

This invention was made with government support under DE-FC07-06ID14781 awarded by The Department of Energy. The government has certain rights in the invention.

TECHNICAL FIELD

This document relates to a dual flask and methods and systems employing a dual flask. In some cases, a dual flask provided herein can include two flasks joined near their based by a filter.

BACKGROUND

Flasks come in a number of shapes and a wide range of sizes. In some cases, flasks include a wider vessel "body" and one (or sometimes more) narrower tubular sections at the top called necks which have an opening at the top. Laboratory flask sizes are typically specified by the volume they can hold, typically in metric units such as milliliters (mL or ml) or liters (L or l). Laboratory flasks have traditionally been made of glass, but can also be made of plastic.

Flasks can be used for making solutions or for holding, containing, collecting, or sometimes volumetrically measuring chemicals, samples, solutions, etc. for chemical reactions or other processes such as mixing, heating, cooling, dissolving, precipitation, boiling (as in distillation), or analysis.

SUMMARY

A dual flask provided herein includes at least a first flask structure and a second flask structure. Each flask structure can include a body and a neck. The first body and the second body in a dual flask provided herein can be connected together and have a filter there between such that fluids can be filtered between said first and second bodies. A body in each flask structure provided herein can be a wider part of the vessel, and a neck in each flask structure provided herein can be a narrower tubular part of the vessel. In some cases, each flask structure can have a round-bottom flask structure, where each body comprises a rounded vessel. In some cases, each flask structure can have a flat bottom (e.g., have a structure of an Erlenmeyer flask). In some cases, one or more flask structures can have a side arm. In some cases, each side arm can include a valve. In some cases, each flask structure can have a structure of a Schlenk flask.

A dual flask provided herein can include glass. In some cases, a dual flask provided herein can be formed of glass. In some cases, a filter connecting bodies of the flask structures can be a glass filter. In some cases, a dual flask provided herein can include a borosilicate glass. In some cases, a dual flask provided herein can include a polymer (e.g., PTFE).

A filter between the flask structures in a dual flask provided herein can have any appropriate structure and/or be made of any appropriate material. In some cases, the filter is a glass filter. In some cases, the filter can have an average pore size of between 0.5 μm and 300 μm. In some cases, the filter can have an average pore size of between 1 μm and 100 μm. In some cases, the filter can have an average pore size of between about 2 μm and about 5 μm. In some cases, the filter can have an average pore size of between about 50 μm and about 75 μm.

A dual flask provided herein can have any appropriate size. In some cases, the dual flask can have a total internal volume of between 50 mL and 10 L. In some cases, each of the flask structures can have an internal volume of between 50 mL and 1 L. In some cases, each of the flask structures can have an internal volume of between 100 mL and 150 mL (e.g., about 125 mL).

A dual flask provided herein can allow reactions to be undertaken in the body of one flask structure and filtered into another flask structure while both bodies are retained in a controlled bath and each neck is outside of that controlled bath. In some cases, each neck is at least 5 cm long (e.g., between 5 cm and 15 cm long). In some cases, a dual flask provided herein can allow a solution to be separated from insoluble material while being kept in an inert atmosphere, and while being kept at a certain temperature by submersion in a hot/cold bath. For example, a dual flask provided herein can be a dual Schenk flask where each body has a round bottom and air can be evacuated through side arms in a long neck outside of a bath, such that air and water can be excluded. Because the round bottoms of the Schenk flask structures are connected, the reaction products can be filtered while in a controlled bath. Passing reaction products through vessels which are not submersed in a temperature controlled bath can be dangerous when a reaction product includes a solvent that boils below room temperature.

The details of one or more embodiments are set forth in the accompanying description below. Other features and advantages will be apparent from the description, drawings, and the claims.

DESCRIPTION OF DRAWINGS

Like reference symbols in the various drawings indicate like elements.

DETAILED DESCRIPTION

A dual flask provided herein includes at least a first flask structure and a second flask structure connected at a wider body portion of each flask structure, with a filter there between, such that fluids can be filtered between the flask structures. A filter being near the bottom of the dual flask can allow fluids to be filtered without the fluid leaving a controlled environment (e.g., a hot or cold water bath). A dual flask provided herein can have flask structures having any appropriate shape and/or structure. In some cases, each flask structure can have a Schlenk flask structure, such as depicted in FIG. 1.

Figure 1:
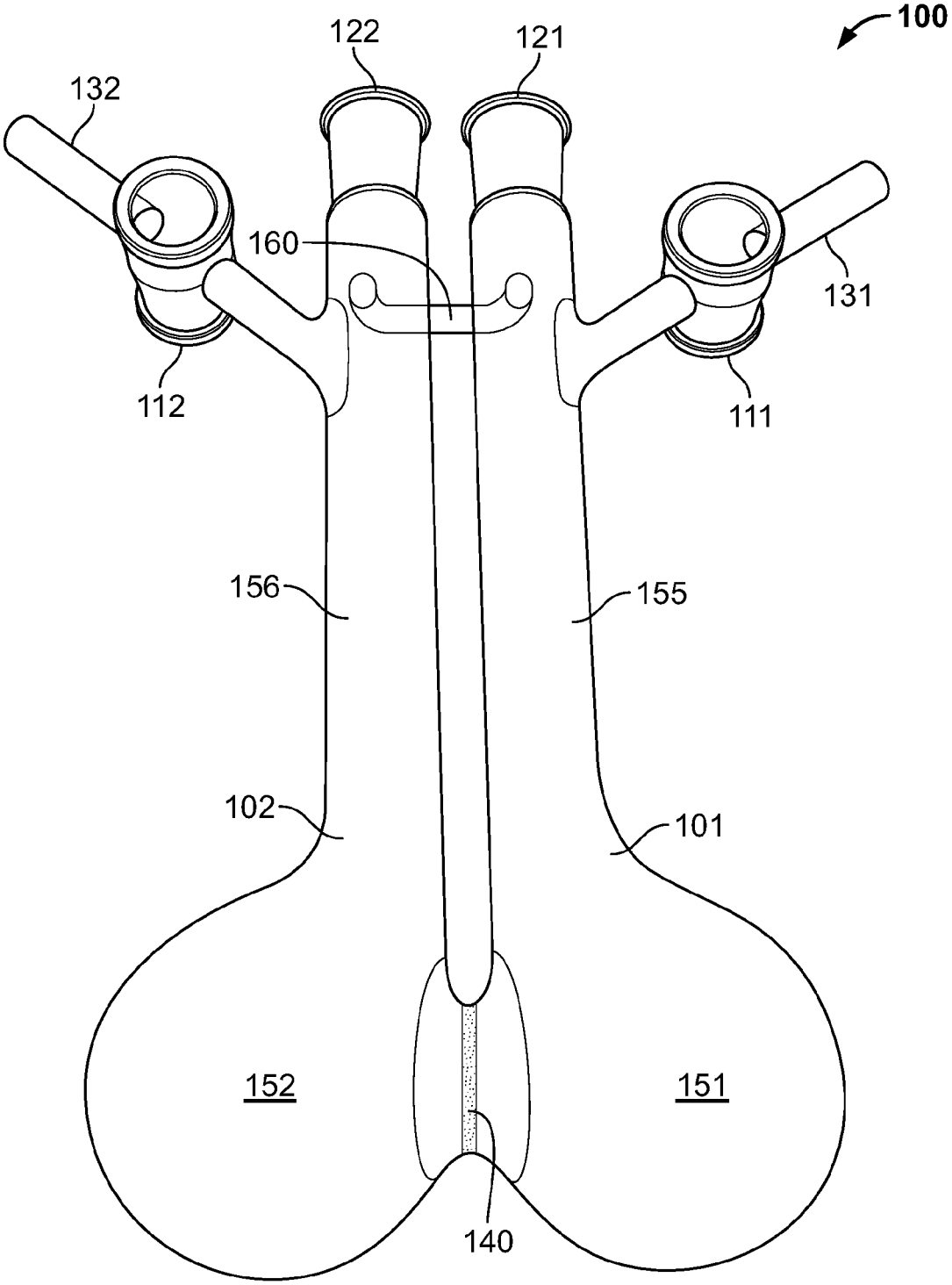
FIG. 1 depicts an exemplary dual flask.

As shown in FIG. 1, a first flask structure 101 can include a first body 151 and a first neck 155. A second flask structure 102 can include a second body 152 and a second neck 156.

First body 151 and second body 152 are fluidly connected and have a filter 140 there between such that fluids can be filtered there between. First body 151 and second body 152 are wider parts of each flask structure, and first neck 155 and second neck 156 are narrower tubular part of each flask structure. In some cases, as shown in FIG. 1, a connecting bridge 160 can connect first neck 155 to second neck 156. A connecting bridge, such as bridge 160, can provide stability, and can have any suitable structure. In some cases, not shown, a connecting bridge can connect first neck 155 and second neck 156 at multiple points or continuously along the lengths of first neck 155 and second neck 156. In some cases, such as that shown in FIG. 1, each flask structure 101 and 102 can have a round-bottom body. In some cases (not shown), each flask structure can have a flat bottom (e.g., have a structure of an Erlenmeyer flask).

Figure 2:
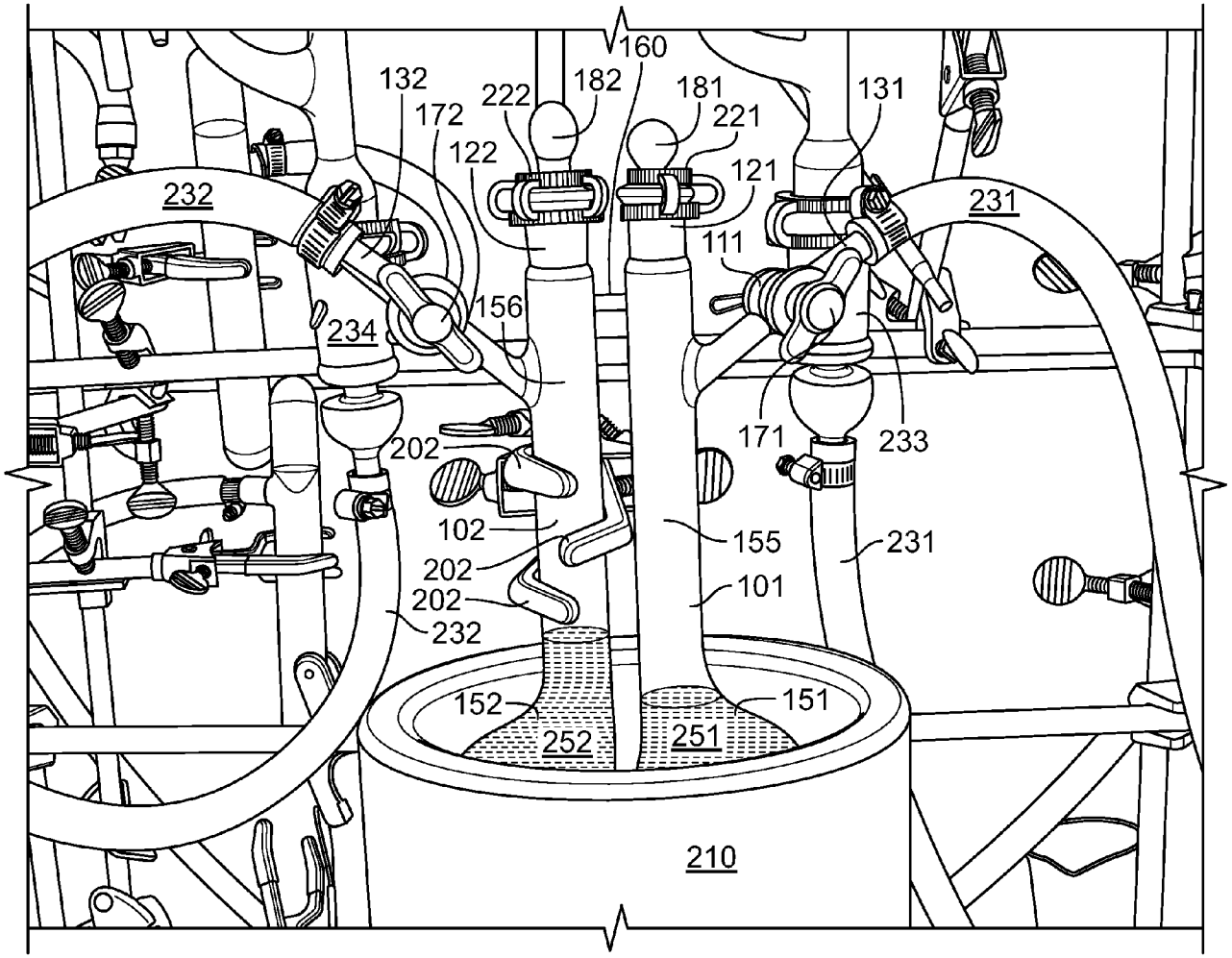
FIG. 2 depicts the exemplary dual flask of FIG. 1 in a temperature controlled bath.
Figure 3A:
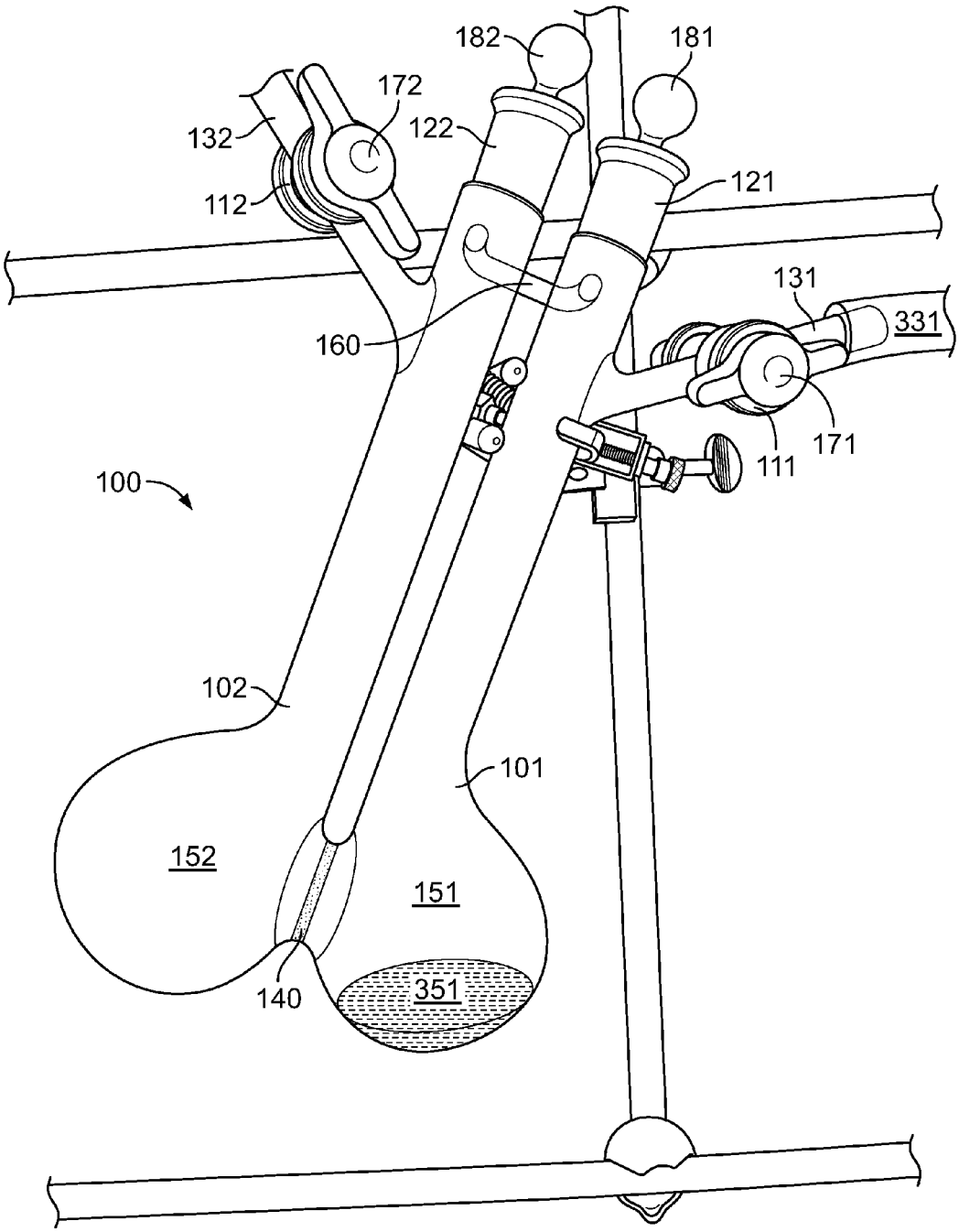
FIGS. 3A and 3B show how the exemplary dual flask of FIG. 1 can be used to filter reaction products.
Figure 3B:
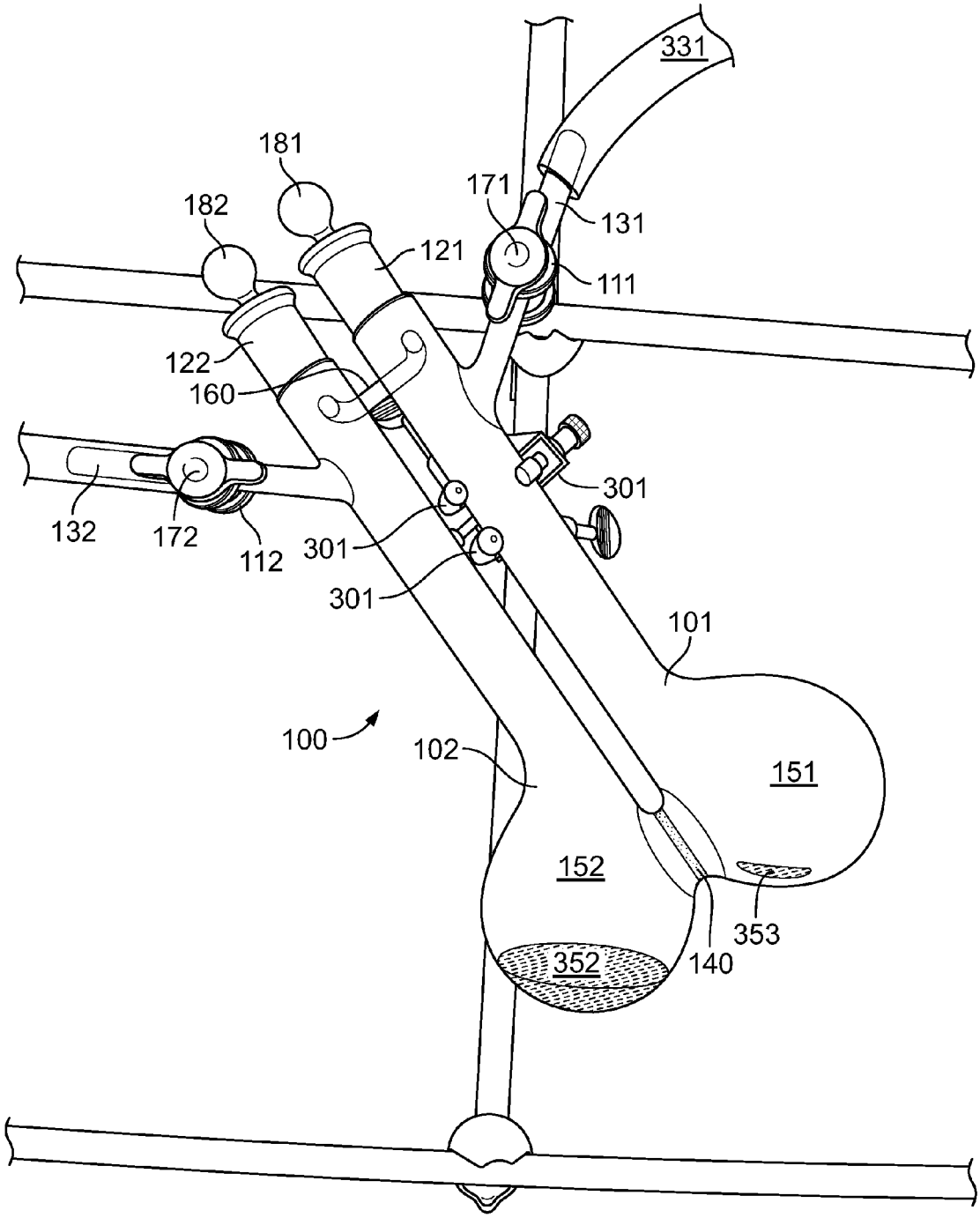

First flask structure 101, as shown in FIG. 1, includes an opening 121 at the top of first neck 155. Opening 121 can include a ground glass joint adapted to receive a septum (e.g., septum 181 as shown in FIGS. 2, 3A, and 3B). In some cases, not shown, opening 121 can include an O-ring. In some cases, not shown, opening 121 can include a Teflon valve and a stopper. First flask structure 101, as shown in FIG. 1, includes a first side arm 131. First side arm 131 can include joint 111 adapted to receive a valve (e.g., valve 171 as shown in FIGS. 2, 3A, and 3B). First side arm 131 can include any suitable type of valve. Joint 111 can, in some cases, be a ground glass joint. In some cases, first side arm 131 can include a Teflon valve and stopper. In some cases first side arm 131 can include a connector including a hose-barb shape, a metal valve, or another fitting. In some cases, first flask structure 101 can have a structure of a Schlenk flask.

Second flask structure 102, as shown in FIG. 1, includes an opening 122 at the top of second neck 155. Opening 122 can include a ground glass joint adapted to receive a septum (e.g., septum 182 as shown in FIGS. 2, 3A, and 3B). In some cases, not shown, opening 122 can include an O-ring. In some cases, not shown, opening 122 can include a Teflon valve and a stopper. Second flask structure 102, as shown in FIG. 1, includes a second side arm 132. Second side arm 132 can include joint 112 adapted to receive a valve (e.g., valve 172 as shown in FIGS. 2, 3A, and 3B). Second side arm 132 can include any suitable type of valve. Joint 112 can, in some cases, be a ground glass joint. In some cases, second side arm 132 can include a Teflon valve and stopper. In some cases second side arm 132 can include a connector including a hose-barb shape, a metal valve, or another fitting. In some cases, second flask structure 102 can have a structure of a Schlenk flask.

Dual flask 100 can be formed out of any suitable material or combination of materials. In some cases, dual flask 100 can include glass. In some cases, dual flask 100 can be formed of glass. In some cases, filter 140 can be a glass filter. In some cases, dual flask 100 can include a borosilicate glass. In some cases, dual flask 100 can include a polymer (e.g., PTFE). Other suitable materials include ceramics and metals.

Filter 140 between flask structures 101 and 102 can have any appropriate structure and/or be made of any appropriate material. In some cases, the filter is a glass filter. In some cases, the filter can have an average pore size of between 0.5 μm and 300 μm. In some cases, the filter can have an average pore size of between 1 μm and 100 μm. In some cases, the filter can have an average pore size of between about 2 μm and about 5 μm. In some cases, the filter can have an average pore size of between about 50 μm and about 75 μm. In some cases, the filter can be made of glass frit, silica frit, Celite frit, or a combination thereof.

Dual flask 100 can have any appropriate size. In some cases, dual flask 100 can have a total internal volume of between 50 mL and 10 L. In some cases, each flask structure 101 and 102 can have an internal volume of between 50 mL and 1 L. In some cases, each flask structure 101 and 102 can have an internal volume of between 100 mL and 150 mL (e.g., about 125 mL).

A dual flask provided herein can allow reactions to be undertaken in the body of one flask structure and filtered into another flask structure while both bodies are retained in a controlled bath and each neck is outside of that controlled bath. In some cases, each neck is at least 5 cm long (e.g., between 5 cm and 15 cm long). In some cases, a dual flask provided herein can allow a solution to be separated from insoluble material while being kept in an inert atmosphere, and while being kept at a certain temperature by submersion in a hot/cold bath. For example, a dual flask provided herein can be a dual Schenk flask where each body has a round bottom and air can be evacuated through side arms in a long neck outside of a bath, such that air and water can be excluded. Because the round bottoms of the Schenk flask structures are connected, the reaction products can be filtered while in a controlled bath. In some cases, round bottoms of bodies 151 and 152 can allow reactions to be undertaken, and then filtered into the other body. Passing reaction products through vessels which are not submersed in a temperature controlled bath can be dangerous when a reaction product includes a solvent that boils below room temperature. For example, dual flasks provided herein can allow a solution to be separated from insoluble material while being kept in an inert atmosphere, and while being kept at a certain temperature by submersion in a hot/cold bath.

FIG. 2 depicts an example of how dual flask 100 can be positioned with both first body 151 and second body 152 in a hot/cold bath 210 such that contents 251 and 252 are maintained at a desired temperature. Clamps 202 can hold first or second necks 155 or 156. Septum 181 and 182 can be in openings 121 and 122, and held in place using cap holders 221 and 222. For example, Schenk lines 231 and 232 can be connected to side arms 131 and 132 to pull a vacuum or introduce a fluid from ports 233 and 234. FIGS. 3A and 3B demonstrate how dual flask 100 can be tilted while held by clamps 301 to filter a precipitate from a solution.

Dual flasks provided herein, such as dual flask 100 as shown in FIG. 1, can in some cases be used to synthesize uranium nitrides by conversion of uranium amide/imide mixtures obtained from a reaction of uranium tetrachloride and sodium amide in liquid ammonia in the presence of dissolved sodium metal. Uranium tetrachloride and sodium amide in liquid ammonia gave an amorphous material composed of uranium dioxide, disodium uranium dinitride, and uranium chloronitride upon heating under vacuum. When a sub-stoichiometric amount of sodium metal, relative to the uranium, is dissolved in the liquid ammonia, a mixture of uranium nitrides is formed upon heating under vacuum. For example, referring to FIG. 3A, $UCl_4$ and $NaNH_2$ can be added to first flask structure 101 of dual flask 100. In some cases, sodium metal can be added to first flask structure 101. Dual flask 100 can be cooled by a dry ice/acetone bath (not shown in FIG. 3A) and anhydrous $NH_3$ can be cannulated onto the mixture through first side arm 131 from Schenk line 331 to form a mixture 351 in first body 151. In some cases, $NH_3$ liquid can be condensed in first body 151. In some cases, a brown precipitate can form after 3 hours. After the precipitate is formed in the mixture 351 the first body 151, the slurry can be filtered through filter 140 by tilting dual flask 100 as shown in FIG. 3B, to leave a precipitate 353 in the first body 151 and have a solution 352 in second body 152. The solution 352 in second body 152 can be allowed to boil off to leave a second residue (e.g., a white residue). Dual flask 100 can then be placed under vacuum and transferred to a glovebox. Precipitate 353 can then be heated at 700° C.-800° C. for three hours under vacuum to leave an off-black material. By using a dual flask provided herein, slurry 351 can be filtered to separate solution 352 from precipitate 353 while keeping slurry 351 under vacuum and in the dry ice/acetone bath.

What is claimed is:

1. A dual flask for laboratory use comprising:

a first flask structure, said first flask structure comprising a first body fluidly coupled to a first neck, the first neck defining an opening of the first flask structure and wherein a first portion of the first neck is configured to receive a first stopper; and a second flask structure, said second flask structure comprising a second body fluidly coupled to a second neck, the second neck defining an opening of the second flask structure and wherein a second portion of the second neck is configured to receive a second stopper;

wherein a first longitudinal axis is defined by the first neck and a second longitudinal axis is defined by the second neck, wherein the first and second longitudinal axes are substantially parallel and separated by a neck separation distance;

wherein said first body is fluidly coupled directly to said second body and a filter is positioned between said first body and said second body such that fluids can be filtered between said first and second bodies, wherein the filter defines a thickness of adjoined portions of the first and second bodies, wherein the thickness of the filter is not larger than the neck separation distance;

wherein the first and second bodies are each defined by a first length, the first and second necks each defined by a second length, and the second length is at least two times greater than the first length such that reactions can be undertaken in the first body and filtered into the second body while both the first body and the second body are retained in a controlled bath and at least a majority of the first neck and the second neck are outside of the controlled bath.

2. The dual flask of claim 1, wherein said first flask structure and said second flask structure comprise glass.

3. The dual flask of claim 2, wherein said filter comprises glass.

4. The dual flask of claim 3, wherein the dual flask comprises a borosilicate glass.

5. The dual flask of claim 4, wherein said first body and said second body comprise bulbous-shaped vessels.

6. The dual flask of claim 5, wherein said first neck comprises a first side arm.

7. The dual flask of claim 6, wherein said second neck comprises a second side arm.

8. The dual flask of claim 7, wherein said second side arm comprises a second valve.

9. The dual flask of claim 8, wherein the filter has an average pore size of between 0.05 μm and 300 μm.

10. The dual flask of claim 9, wherein the filter has an average pore size of between 1 μm and 100 μm.

11. The dual flask of claim 10, wherein each of said first and second flask structures have an internal volume of between 50 mL and 1 L.

12. The dual flask of claim 11, wherein each of said first and second flask structures have an internal volume of between 100 mL and 150 mL.

13. The dual flask of claim 6, wherein said first side arm comprises a first valve.

14. The dual flask of claim 1, wherein said first flask structure and said second flask structure each comprise a Schlenk Flask structure.

15. The dual flask of claim 1, wherein the first and second flask structures each have a flat bottom.

16. The dual flask of claim 1, wherein the first and second bodies each comprise a rounded vessel shape defined by a top portion, a mid-portion portion, and a bottom portion, wherein the mid-portion is wider than the top and bottom portions.

17. The dual flask of claim 1, wherein the filter is located near the bottom portions of the first and second bodies and the filter is configured to separate a precipitate from a solution.

18. The dual flask of claim 1, further comprising a stability bridge configured to couple the first neck and the second neck at multiple points along the lengths of the first and second necks.

19. The dual flask of claim 1, wherein the first and second portions of the first and second necks are each defined by a third length, and wherein the first length is greater than the third length.

20. The dual flask of claim 19, wherein the first and second portions of the first and second necks each define a first diameter, and wherein a third portion of the first neck and a fourth portion of the second neck, distinct from the first and second portions of the first and second necks, each define a second diameter, and wherein the second diameter is greater than the first diameter.

* * * * *